US009664387B2

(12) United States Patent
Gerold et al.

(10) Patent No.: US 9,664,387 B2
(45) Date of Patent: May 30, 2017

(54) WORK APPARATUS FOR SETTING FASTENING ELEMENTS

(71) Applicant: Hilti Aktiengesellschaft, Schaan (LI)

(72) Inventors: Uwe Gerold, Lindau (DE); Thorsten Sauer, Goefis (AT); Norbert Welte, Klaus (AT)

(73) Assignee: Hilti Aktiengesellschaft, Schaan (LI)

( * ) Notice: Subject to any disclaimer, the term of this patent is extended or adjusted under 35 U.S.C. 154(b) by 827 days.

(21) Appl. No.: 13/861,520

(22) Filed: Apr. 12, 2013

(65) Prior Publication Data

US 2013/0288191 A1 Oct. 31, 2013

(30) Foreign Application Priority Data

Apr. 25, 2012 (DE) ..... 10 2012 206 764

(51) Int. Cl.
*F23N 5/02* (2006.01)
*B25C 1/08* (2006.01)

(52) U.S. Cl.
CPC . *F23N 5/02* (2013.01); *B25C 1/08* (2013.01)

(58) Field of Classification Search
CPC ..... F23N 5/02
USPC ..... 432/1, 49; 123/4 H, 46 R; 227/9, 10
See application file for complete search history.

(56) References Cited

U.S. PATENT DOCUMENTS 6,123,241 A 9/2000 Walter et al.
2003/0154956 A1* 8/2003 Eckerle ..... F02D 41/00 123/357
2005/0173485 A1* 8/2005 Moeller ..... B25C 1/08 227/10
2005/0224024 A1 10/2005 Granacher et al.
2005/0247748 A1 11/2005 Schiestl
2006/0260568 A1 11/2006 Moeller et al.
2009/0200353 A1 8/2009 Dittrich et al.
2009/0250499 A1* 10/2009 Hahn ..... B25C 1/08 227/10
2009/0251330 A1 10/2009 Gerold et al.
2011/0235679 A1 9/2011 Cordeiro et al.

FOREIGN PATENT DOCUMENTS

| | | | |
|---|---|---|---|
| CN | 101203357 | A | 6/2008 |
| CN | 102198652 | A | 9/2011 |
| DE | 102 59 775 | A1 | 7/2004 |
| DE | 10 2008 000 973 | A1 | 10/2009 |
| EP | 1593462 | A1 | 11/2005 |
| EP | 2090404 | A2 | 8/2009 |
| GB | 2 418 636 | A | 4/2006 |

* cited by examiner

*Primary Examiner* — Alissa Tompkins
*Assistant Examiner* — John Bargero
(74) *Attorney, Agent, or Firm* — Jeremy Jay

(57) ABSTRACT

The invention relates to a work apparatus for setting fastening elements in a substrate, with a fuel container and with a dosing device, through which the fuel is fed from the fuel container into a combustion chamber in which a flammable mixture is ignited, for setting a fastening element, and with a temperature sensor. In order to prevent undesired malfunctioning in the operation of the work apparatus or to reduce the incidence of such malfunctioning, the work apparatus comprises a container temperature sensor and a dosing temperature sensor.

5 Claims, 1 Drawing Sheet

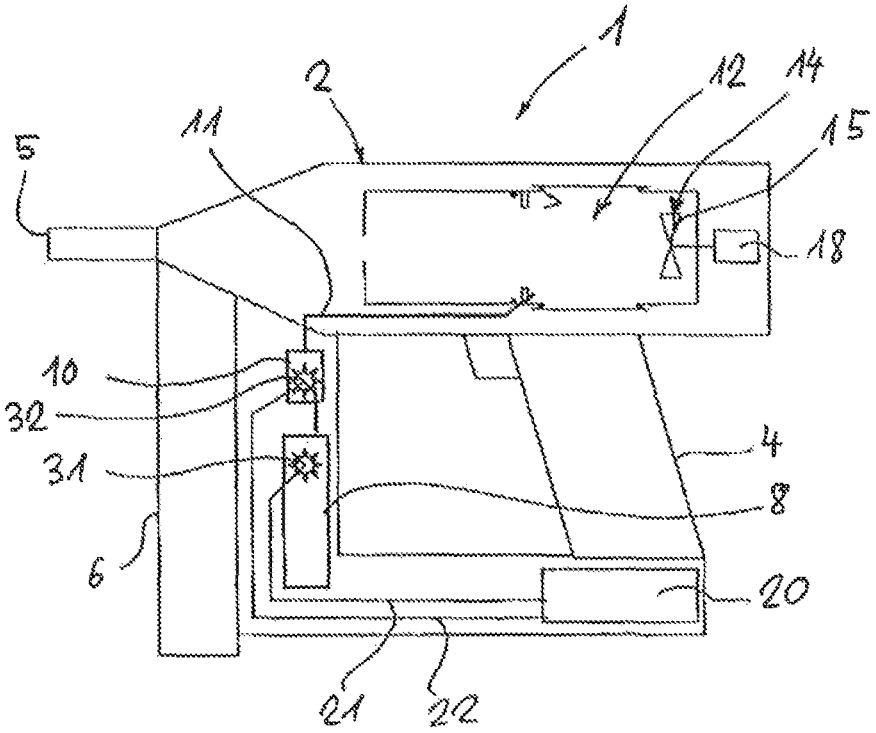
1
2
11
12
14
15
5
18
10
32
31
4
8
6
20
21
22

WORK APPARATUS FOR SETTING FASTENING ELEMENTS

CROSS-REFERENCE TO RELATED APPLICATIONS

This patent application claims the benefit of German Patent Application No. DE 102012206764.7, filed Apr. 25, 2012, which is incorporated by reference.

TECHNICAL FIELD

The invention relates to a work apparatus for setting fastening elements in a substrate, with a fuel container and a dosing device, through which the fuel is fed from the fuel container into a combustion space in which a flammable mixture is ignited, for setting a fastening element, and with a temperature sensor. The invention further relates to a method for operating such a work apparatus.

BACKGROUND OF THE INVENTION

From the German Offenlegungsschrift DE 10 2008 000 973 A1, a hand-held work apparatus with a temperature sensor for monitoring the temperature of the apparatus or the environment is known.

BRIEF SUMMARY OF THE INVENTION

The task of the invention is to reduce undesired malfunctioning in the operation of a work apparatus according to the preamble of claim 1, or to reduce the number thereof.

The task is solved, in the case of a work apparatus for setting fastening elements in a substrate, with a fuel container and a dosing device, through which the fuel is fed from the fuel container into a combustion space in which a flammable mixture is ignited, for setting a fastening element, and with a temperature sensor, in that the work apparatus comprises a container temperature sensor and a dosing temperature sensor. The work apparatus is preferably a hand-held work apparatus for setting bolts that is operated with a fuel gas. Therefore, the work apparatus is also referred to as a gas-operated bolt setting apparatus or bolt thrusting tool. The fuel in the fuel container is preferably in the form of a liquid fuel gas that evaporates in a technically disadvantageous, critical operating state, also referred to as vapor lock state or vapour lock state, in the dosing device, and assumes a larger volume. Depending on the dosing type, this can lead to incorrect dosing quantities. This is especially the case with volumetric and time-control dosages, and can lead to considerable ignition malfunctioning in the operation of the work apparatus. Due to the combination according to the invention of a container temperature sensor with a dosing temperature sensor in the work apparatus, critical operating states, particularly vapor lock states, can be detected and prevented in a simple manner. As a result, the operating safety in the operation of the work apparatus according to the invention can be increased. In addition, the arrangement of the fuel container relative to the dosing device in the work apparatus is simplified.

A preferred embodiment example of the work apparatus is characterized in that the container temperature sensor and the dosing temperature sensor are connected for control purposes to a measurement value acquisition unit. In the measurement value acquisition unit, the data detected by the container temperature sensor and the dosing temperature sensor is processed and stored. Subsequently, suitable apparatus-internal measures can be taken in order to prevent undesired critical operating states or reduce the number thereof.

An additional preferred embodiment example of the work apparatus according to the invention is characterized in that the container temperature sensor is arranged on or in the fuel container. The temperature of the fuel in the fuel container is preferably detected by means of the container temperature sensor.

An additional preferred embodiment example of the work apparatus according to the invention is characterized in that the dosing temperature sensor is arranged on or in the dosing device. The temperature of the fuel supplied via the dosing device to the combustion space is preferably acquired by means of the dosing temperature sensor.

In a method for operating an above-described work apparatus, the above-indicated problem is solved alternatively or additionally in that the data detected by the container temperature sensor and the dosing temperature sensor is used inside the apparatus in order to detect and/or prevent critical operating states. The method according to the invention can also be used advantageously in the development of previously described work apparatuses.

A preferred embodiment example of the method is characterized in that, from the data detected by the container temperature sensor and by the dosing temperature sensor, a temperature difference is determined that is compared to a maximum admissible limit temperature difference. In the context of the present invention, it was recognized that the absolute temperature of the fuel in the dosing device is less responsible for the occurrence of a vapor lock state than the temperature difference between the fuel container and the dosing device. The maximum admissible limit temperature difference depends on the vapor pressure curve of the gas composition used, and it is preferably stored as a fixed value in a memory of the work apparatus and accessed during the process. In an alternative embodiment, the composition of the gas is coded on the gas container and it can be read by the work apparatus, wherein the maximum admissible limit temperature difference for the respective gas composition is then stored in a memory. Moreover, in additional alternative embodiments, the pressure and/or the temperature of the gas is/are also determined, for example, by means of a pressure sensor and the container temperature sensor, and taken into consideration in the determination of the maximum admissible limit temperature difference.

An additional preferred embodiment example of the method is characterized in that a signal is generated as soon as the maximum admissible limit temperature difference has been exceeded. If the maximum admissible limit temperature difference is exceeded, then it is assumed that the fuel has already evaporated in the dosing device. This can lead to the dosing quantity being insufficient.

An additional preferred embodiment example of the method is characterized in that the signal is generated in the form of a visual, haptic and/or acoustic signal to the user of the work apparatus. The visual signal can be produced, for example, in the form of a red blinking light on the outside of the work apparatus. The haptic signal can be produced, for example, in the form of an additional vibration of the handle of the work apparatus. The acoustic signal can be produced, for example, in the form of a warning sound that is generated in the work apparatus.

An additional preferred additional embodiment example of the method is characterized in that the signal is used inside the apparatus in order to reduce the detected temperature difference. For example, apparatus-internal cooling measures for the dosing device and/or for the combustion space can be taken.

An additional preferred embodiment example of the invention is characterized in that an apparatus-internal aerator is switched on in order to reduce the detected temperature difference. An apparatus-internal aerator or ventilator can be used for cooling the combustion space or the mixture in the combustion space. Peltier elements can be used alternatively or additionally.

BRIEF DESCRIPTION OF THE SEVERAL VIEW OF THE DRAWING(S)

Further advantages, characteristics and details of the invention can be obtained from the following description, in which various embodiment examples are described in detail with reference to the drawing.

FIG. 1 shows a simplified representation of the work apparatus according to the invention.

DETAILED DESCRIPTION OF THE INVENTION

Embodiment Examples

FIG. 1 is a highly simplified representation of a work apparatus 1 according to the invention with a housing 2. The work apparatus 1 is a hand-held bolt setting apparatus with a handle 4 by which the bolt setting apparatus 1 can be gripped for driving a fastening element that exits at one bolt guide end 5 from the bolt setting apparatus 1 and is driven into a substrate.

The fastening elements used are provided preferably via an apparatus-internal magazine 6, which is attached in the vicinity of the bolt guide end 5 of the bolt setting apparatus 1. The fastening elements are removed automatically, preferably individually, from the magazine 6, and made available at the bolt guide end 5.

The energy needed for driving the fastening elements into the substrate is provided in a fuel container 8 in the interior of the bolt setting apparatus 1. The fuel container 8 contains preferably liquid fuel gas and it is therefore also referred to as a gas container or a gas cartridge.

The fuel container 8 can be connected via an adjustable or variable dosing device 10 and a gas line 11 to a combustion chamber or a combustion space 12. The dosing device 10 preferably comprises a dosing valve through which the gas quantity that is introduced into the combustion space can be controlled, for example, volumetrically or as a function of time.

In the combustion space 12, a fuel, particularly a gas, from the fuel container 8 is mixed with air to form a flammable mixture that is ignited in order to drive the fastening element, such as a bolt or a nail, into the substrate. The energy required for driving is transmitted, for example, via a work piston (not shown), from the combustion chamber 12 to a fastening element at the bolt guide end 5.

In the combustion chamber 12, a device 14 is arranged that is used to generate turbulence in the combustion space 12 and to rinse and/or cool the combustion space 12. The device 14 comprises a ventilator 15 that is driven by an electromotor 18. The electromotor 18 is actuated by an electronic control device 20.

The control device 20 comprises a measurement value acquisition unit, from which two lines 21, 22 originate. A container temperature sensor 31 is connected to the control device 20 via the line 21. A dosing temperature sensor 32 is connected to the control device 20 via the line 22.

The container temperature sensor 31 is used to detect the temperature of the fuel in the fuel container 8. The dosing temperature sensor 32 is used to detect the temperature of the fuel or gas that is supplied via the dosing device 10 to the combustion space 12.

In the case of gas-operated bolt setting apparatuses, a critical operating state can occur in which liquid fuel gas evaporates in the dosing device and assumes a larger volume. This critical operating state is also referred to as a vapor lock state and it can lead to incorrect dosing quantities, particularly in volumetric and time-controlled dosage operations, since the dosing quantities are adjusted on the basis of the liquid phase of the fuel. This in turn can lead to considerable ignition malfunctioning. Using the two sensors 31 and 32, a transition of the fuel gas from the liquid to the gaseous phase in the dosing device 10 can be detected.

The temperature data detected by the two sensors 31 and 32 is evaluated and stored in the measurement value acquisition unit in the control unit 20. It is possible to associate the critical operating state, which is also referred to as a vapor lock state, with a characteristic temperature difference between the fuel container 8 in which the liquid fuel gas is provided and the dosing device 10 through which the liquid fuel gas is supplied to the combustion space 12.

In the operation of the work apparatus 1, the temperature difference between the fuel container 8 and the dosing device 10 can be monitored using the two sensors 31 and 32. In the measurement value acquisition unit, the actual temperature difference detected is compared to a maximum admissible temperature difference. As soon as the maximum admissible temperature difference, also referred to as the limit temperature difference, has been exceeded, the measurement value acquisition unit generates a signal that is further processed inside the apparatus.

The signal indicating that the maximum admissible temperature difference has been exceeded can be displayed, for example, by means of a red warning light on the outside of the apparatus 1 in a manner visible to the user. Alternatively or additionally, apparatus-internal measures can be carried out to reduce the temperature difference. For this purpose, it is possible, for example, to insert an aerator 15 for cooling the mixture in the combustion space 12. In addition, Peltier elements can be used for cooling the combustion space 12.

The invention claimed is:

1. A method for operating a work apparatus for setting fastening elements in a substrate, the work apparatus comprising a fuel container and a dosing device, through which the fuel is fed from the fuel container into a combustion space in which a flammable mixture is ignited, for setting a fastening element into the substrate, the work apparatus also comprising a container temperature sensor, and a dosing temperature sensor, wherein the container temperature sensor is arranged on or in the fuel container and the dosing temperature sensor is arranged on or in the dosing device, and the container temperature sensor and the dosing temperature sensor are connected for control purposes to a measurement value acquisition unit, the method comprising determining a temperature difference from data detected by the container temperature sensor and by the dosing temperature sensor to detect and/or prevent critical operating states, comparing the temperature difference to a maximum admissible limit temperature difference and generating a signal as soon as the maximum admissible limit temperature difference has been exceeded.

2. The method according to claim 1, comprising generating the signal in the form of a visual, haptic and/or acoustic signal to a user of the work apparatus.

3. The method according to claim 1, comprising using the signal inside the apparatus to reduce the detected temperature difference.

4. The method according to claim 3, comprising switching on an apparatus-internal aerator to reduce the detected temperature difference.

5. The method according to claim 2, comprising using the signal inside the apparatus to reduce the detected temperature difference.

* * * * *